US006464343B1

(12) United States Patent
Coventry et al.

(10) Patent No.: US 6,464,343 B1
(45) Date of Patent: Oct. 15, 2002

(54) INK JET PRINTHEAD HAVING THIN FILM STRUCTURES FOR IMPROVING BARRIER ISLAND ADHESION

(75) Inventors: Laurie A. Coventry, Shedd; Allen H. Smith, Corvallis, both of OR (US); Dustin W. Blair, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/003,175

(22) Filed: Oct. 31, 2001

(51) Int. Cl.[7] ..... B41J 2/05; B41J 2/175; B41J 2/17

(52) U.S. Cl. ..... 347/63; 347/93; 347/94

(58) Field of Search ..... 347/63–65, 67, 347/93, 94

(56) References Cited

U.S. PATENT DOCUMENTS 5,463,413 A * 10/1995 Ho et al. ..... 347/65
5,469,199 A * 11/1995 Allen et al. ..... 347/42
6,007,188 A * 12/1999 MacLoed et al. ..... 347/65
6,162,589 A * 12/2000 Chen et al. ..... 347/47

* cited by examiner

*Primary Examiner*—John Barlow
*Assistant Examiner*—Juanita Stephens

(57) ABSTRACT

A fluid drop ejecting apparatus including a thin film stack including a plurality of heater resistors formed on a substrate having a feed edge, a patterned fluid barrier layer disposed on the thin film stack, respective fluid chambers formed in the barrier layer over respective heater resistors, fluid feed features formed in the barrier layer between the fluid feed edge and the ink chambers, and a thin film metal structure in a metal layer of the thin film stack and located between the ink feed edge and the fluid chambers.

32 Claims, 5 Drawing Sheets

110
10
113
-117-
111
115

INK JET PRINTHEAD HAVING THIN FILM STRUCTURES FOR IMPROVING BARRIER ISLAND ADHESION

BACKGROUND OF THE DISCLOSURE

The disclosed invention relates generally to fluid ejecting devices such as ink jet printing devices, and more particularly to a fluid ejecting device having an integrated circuit thin film feature disposed beneath fluid barrier elements.

The art of inkjet printing is relatively well developed. Commercial products such as computer printers, graphics plotters, and facsimile machines have been implemented with ink jet technology for producing printed media. The contributions of Hewlett-Packard Company to ink jet technology are described, for example, in various articles in the Hewlett-Packard Journal, Vol. 36, No. 5 (May 1985); Vol. 39, No. 5 (Oct. 1988); Vol. 43, No. 4 (Aug. 1992); Vol. 43, No. 6 (Dec. 1992); and Vol. 45, No. 1 (Feb. 1994); all incorporated herein by reference.

Generally, an ink jet image is formed pursuant to precise placement on a print medium of ink drops emitted by an ink drop generating device known as an ink jet printhead. Typically, an ink jet printhead is attached to a print cartridge body that is, for example, supported on a movable print carriage that traverses over the surface of the print medium. The ink jet printhead is controlled to eject drops of ink at appropriate times pursuant to command of a microcomputer or other controller, wherein the timing of the application of the ink drops is intended to correspond to a pattern of pixels of the image being printed.

A typical Hewlett-Packard ink jet printhead includes an array of precisely formed nozzles in an orifice structure that is attached to or integral with an ink barrier structure that in turn is attached to a thin film substructure that implements ink firing heater resistors and apparatus for enabling the resistors. The ink barrier structure can define ink flow control structures, particle filtering structures, ink passageways or channels, and ink chambers. The ink chambers are disposed over associated ink firing resistors, and the nozzles in the orifice structure are aligned with associated ink chambers. Ink drop generator regions are formed by the ink chambers and portions of the thin film substructure and the orifice structure that are adjacent the ink chambers.

A consideration with a printhead that employs an ink barrier structure is the reliability and robustness of the adhesion of the barrier layer to the thin film substructure.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
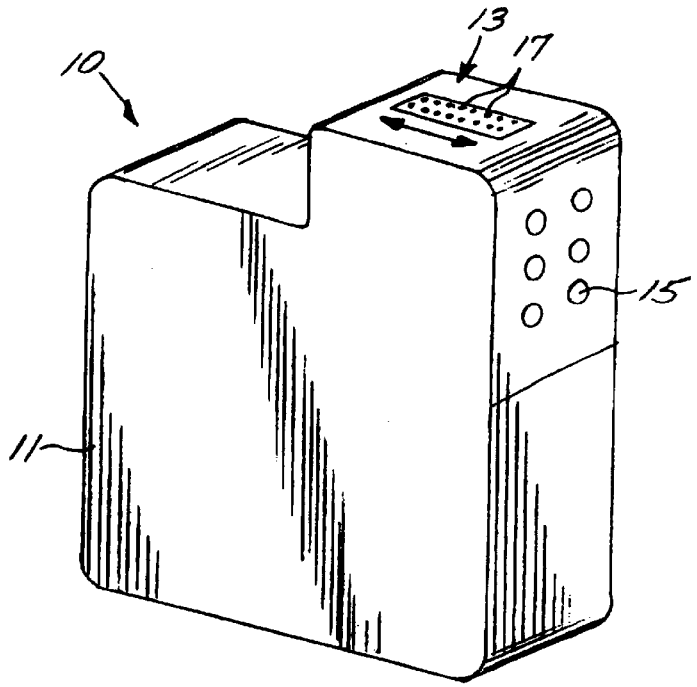
FIG. 1 is schematic perspective view of a print cartridge that can incorporate an ink jet printhead in accordance with the invention.

FIG. 1 is a schematic perspective view of one type of ink jet print cartridge 10 that can incorporate a fluid drop ejecting apparatus in accordance with the invention. The print cartridge 10 includes a cartridge body 11, a printhead 13, and electrical contacts 15. The cartridge body 11 contains ink or other suitable fluid that is supplied to the printhead 13, and electrical signals are provided to the contacts 15 to individually energize ink drop generators to eject a droplet of fluid from a selected nozzle 17. The print cartridge 10 can be a disposable type that contains a substantial quantity of ink within its body 11. Another suitable print cartridge may be of the type that receives ink from an external ink supply that is mounted on the print cartridge or fluidically connected to the print cartridge by a conduit such as a tube.

While the disclosed structures are described in the context of ink drop jetting, it should be appreciated that the disclosed structures can be employed for drop jetting of other fluids.

Figure 2:
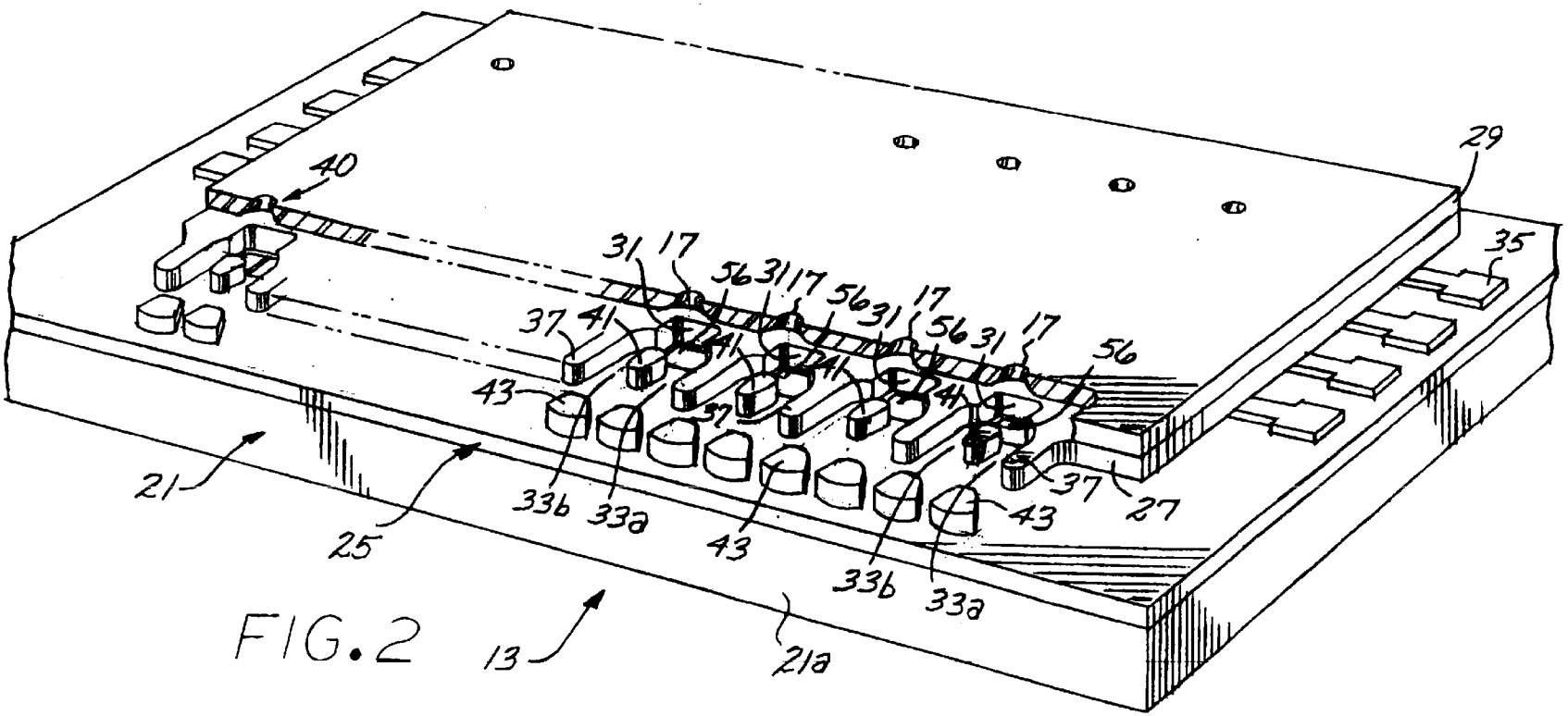
FIG. 2 is a schematic perspective view of an example of a printhead in accordance with the invention.

Referring to FIG. 2, set forth therein is an unscaled schematic perspective view of an example of the ink jet printhead 13 which generally includes a silicon substrate 21 and an integrated circuit thin film stack 25 of thin film layers formed on the silicon substrate 21. The thin film stack 25 implements ink firing heater resistors 56 and associated electrical circuitry such as drive circuits and addressing circuits, and can be formed pursuant to integrated circuit fabrication techniques. Byway of illustrative example, the thin film heater resistors 56 are located in columnar arrays along longitudinal ink feed edges 21*a* of the silicon substrate 21.

An ink barrier layer 27 is disposed over the thin film stack 25, and an orifice or nozzle plate 29 containing the nozzles 17 is in turn laminarly disposed on the ink barrier layer 27. Gold bond pads 35 engagable for external electrical connections are disposed at the ends of the thin film stack 25 and are not covered by the ink barrier layer 27. The ink barrier layer 27 is formed, for example, of a dry film that is heated and pressure laminated to the thin film stack 25 and photodefined to form therein ink chambers 31, ink channels 33*a*, 33*b*, and barrier islands 41, 43. By way of illustrative example, the barrier layer material comprises an acrylate based photopolymer dry film such as the Parad brand photopolymer dry film obtainable from E.I. duPont de Nemours and Company of Wilmington, Del. Similar dry films include other duPont products such as the Riston brand dry film and dry films made by other chemical providers. The orifice plate 29 comprises, for example, a planar substrate comprised of a polymer material and in which the orifices 17 are formed by laser ablation, for example as disclosed in commonly assigned U.S. Pat. No. 5,469,199, incorporated herein by reference. The orifice plate can also comprise, by way of further example, a plated metal such as nickel.

The ink chambers 31 in the ink barrier layer 27 are more particularly disposed over respective ink firing resistors 56 formed in the thin film stack 25, and each ink chamber 31 is defined by the edge or wall of a chamber opening formed in the barrier layer 27. The ink channels 33*a*, 33*b* are defined by barrier features formed in the barrier layer 27 including barrier peninsulas 37 and barrier channel islands 41, and are integrally joined to respective ink firing chambers 31. Barrier reef islands 43 can be located along the feed edge 21*a*.

The orifices 17 in the orifice plate 29 are disposed over respective ink chambers 31, such that an ink firing resistor 56, an associated ink chamber 31, and an associated orifice 17 form an ink drop generator 40.

The ink barrier layer 27 and orifice plate 29 can alternatively be implemented as an integral ink channel and orifice structure, for example as described in U.S. Pat. No. 6,162,589.

Figure 3:
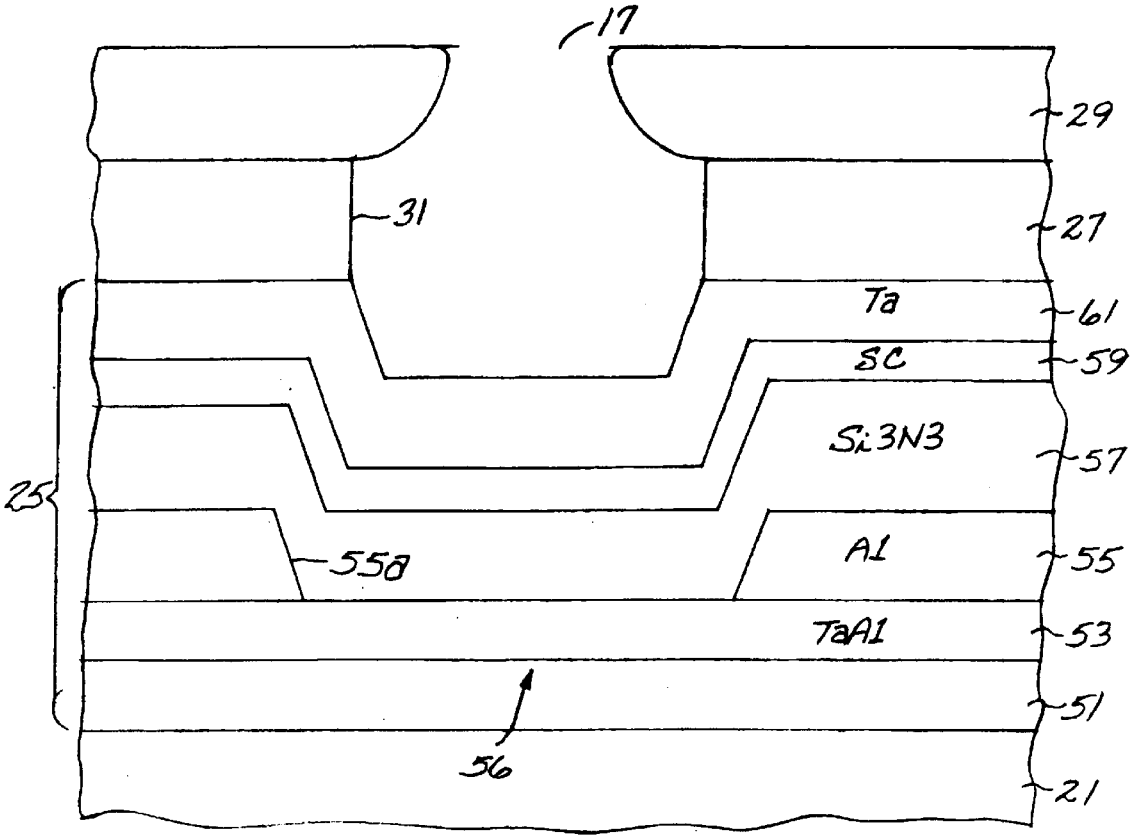
FIG. 3 is a schematic cross-sectional view of a portion of the printhead of FIG. 2 depicting examples of major components of the thin film stack of the printhead.

FIG. 3 is a schematic cross-sectional view of a portion of the thin film stack 25 depicting examples of major components of the thin film stack 25. An active device substructure 51 embodying active devices such as FET drive circuits is formed on the silicon substrate 21. A patterned tantalum/aluminum (Ta/Al) resistive layer 53 is disposed on the active device substructure 51, and a patterned aluminum (Al) layer 55 is on the tantalum/aluminum layer. Heater resistors 56 are defined by gaps 55*a* in traces in the aluminum layer 55 whereby the portion of the resistive layer 53 that underlies the gap 55*a* comprises the heater resistor 56. A silicon nitride (Si3N4) layer 57 and a silicon carbide (SiC) layer 59 are passivation layers disposed over the aluminum layer 55. A tantalum layer 61 on the silicon carbide layer 59 functions as a mechanical passivation layer in the ink chambers 31 that absorbs the impact of bubble collapse.

As more particularly depicted in FIGS. 4–7, the thin film stack 25 includes a thin film metal underlay structure formed in the aluminum layer 55 or tantalum layer 61, or both, and underlying at least the barrier reef islands 43 and extending laterally toward the ink chambers 31. The thin film metal structure more particularly comprises one or more metal regions that are in or occupy a region of the printhead that underlies the barrier reef islands 43 and can extend laterally toward the ink chambers 31. Such thin film metal structure can improve the adhesion between the thin film stack and the portions of the barrier layer 27 that overlie the thin film metal underlay structure.

Figure 4:
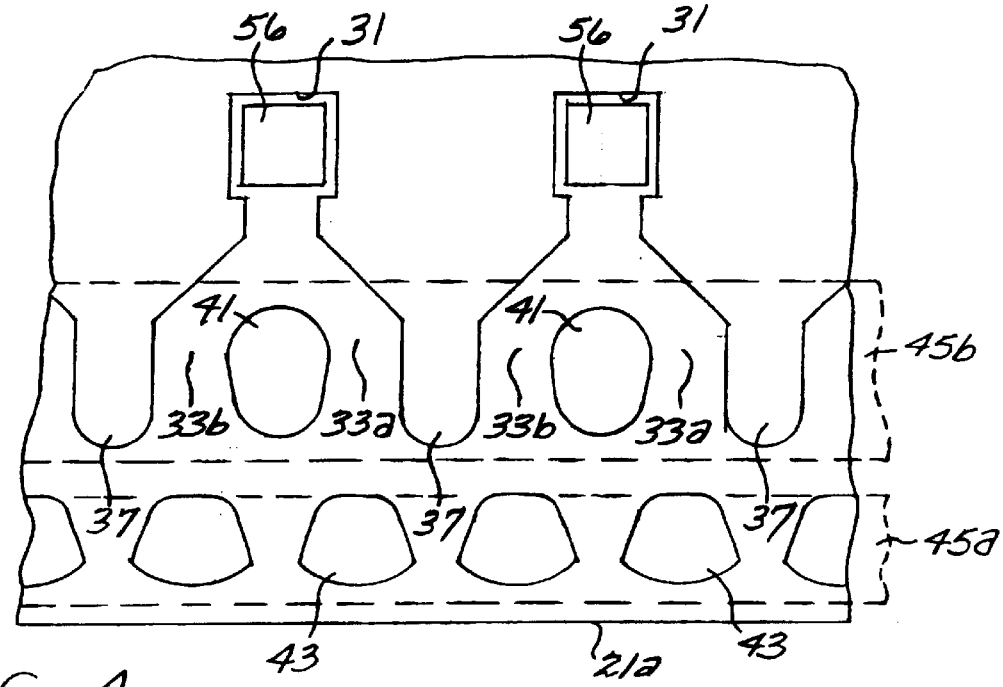
FIG. 4 is a schematic top plan view illustrating an example of a thin film metal underlay structure that underlies selected portions of the barrier layer of the printhead of FIGS. 2 and 3.

FIG. 4 is an unscaled partial top plan view illustrating an embodiment wherein the thin film metal structure comprises an elongated metal strip 45*a* disposed beneath the barrier reef islands 43. The metal strip 45*a* extends longitudinally so as to span or subtend the desired barrier reef islands for example. A further elongated metal strip 45*b* can also be provided under the channel islands 41. The metal strips 45*a*, 45*b* can be formed in the aluminum layer 55 or the tantalum layer 61, or both.

Figure 5:
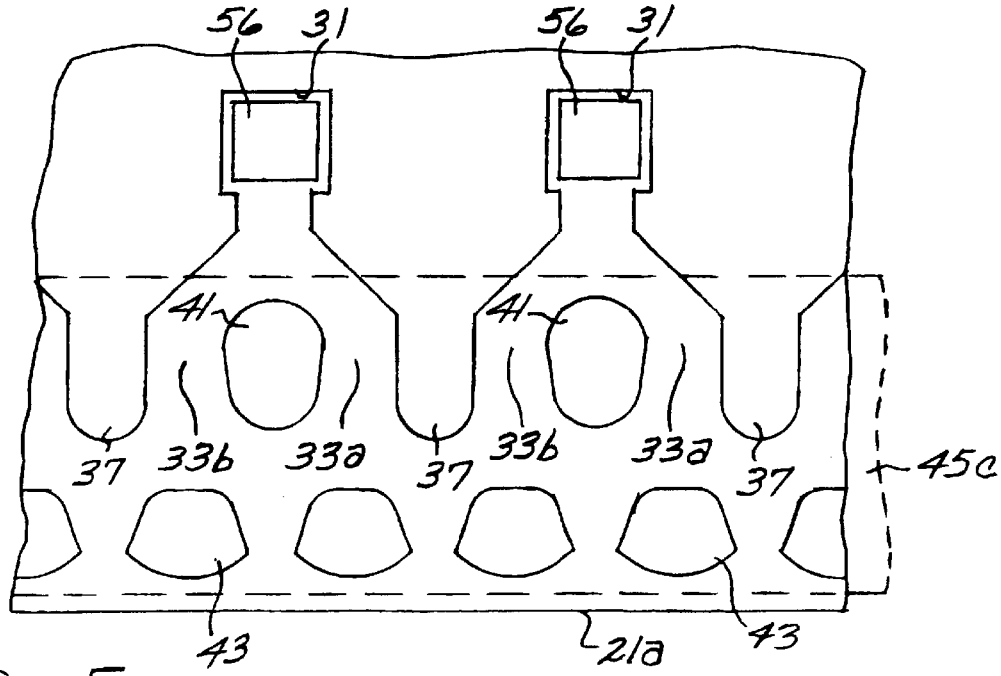
FIG. 5 is a schematic top plan view illustrating another example of a thin film metal underlay structure that underlies selected portions of the barrier layer of the printhead of FIGS. 2 and 3.

FIG. 5 is an unscaled partial top plan view illustrating an embodiment wherein the thin film metal structure comprises a metal slab 45*c* that underlies the barrier reef islands 43 and extends laterally to the ink chambers 31, for example, or to lesser lateral extent. The metal slab 45*c* can be considered as being a wider version of the metal strip 45*a* of FIG. 4. The metal slab 45*c* extends longitudinally so as to span or subtend the desired barrier reef islands 43 or barrier peninsulas 37, for example. The metal slab 45*c* can be formed in the tantalum layer 61 and/or the aluminum layer 55 of the thin film stack 25.

Figure 6:
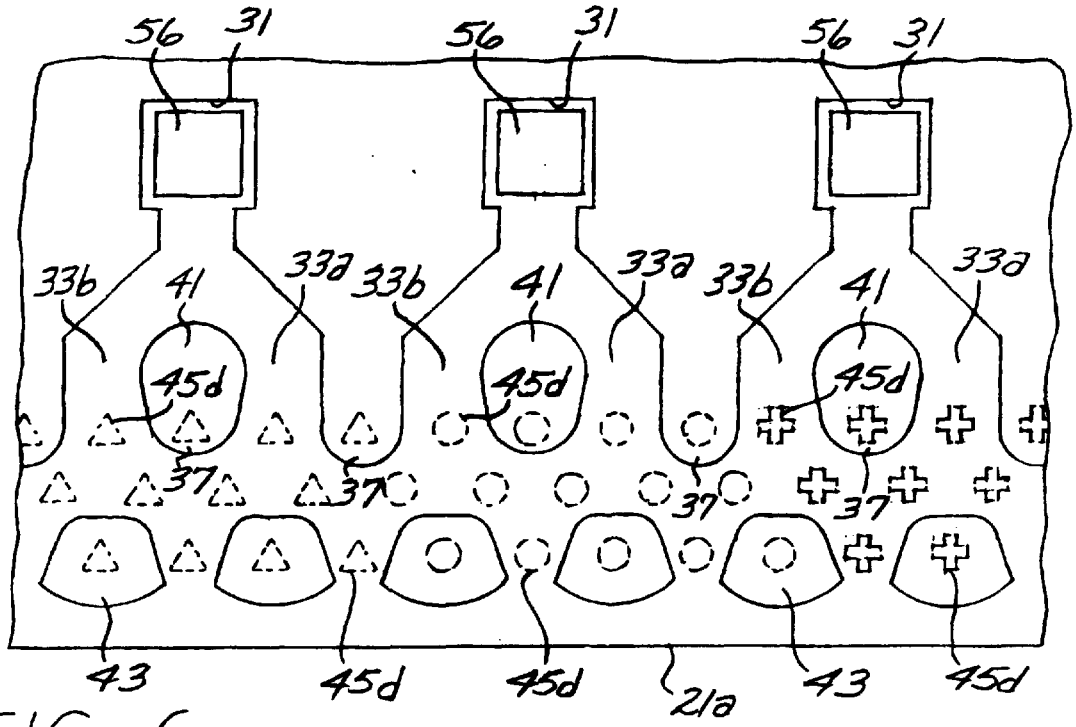
FIG. 6 is a schematic top plan view illustrating a further example of a thin film metal underlay structure that underlies selected portions of the barrier layer of the printhead of FIGS. 2 and 3.

FIG. 6 is an unscaled partial top plan view illustrating an embodiment wherein the thin film metal structure comprises an array of metal islands or pads 45*d* in a region that underlies the barrier reef islands 43 and can extend inwardly toward the ink chamber 31. The metal islands or pads 45*d* thus underlie at least the barrier reef islands 43, and can underlie portions of the barrier peninsulas 37 and the channel islands 41. The metal islands or pads 45*d* can be formed in the aluminum layer 55 or the tantalum layer 61, or both. The metal pads can be triangular, cylindrical, cross-shaped, or any other shape. The metal pads 45*d* can have respective areas that are smaller than the area of the smallest one of the barrier reef islands 43, for example. Alternatively, the metal pads 45*d* can be larger than the barrier reef islands 43.

Figure 7:
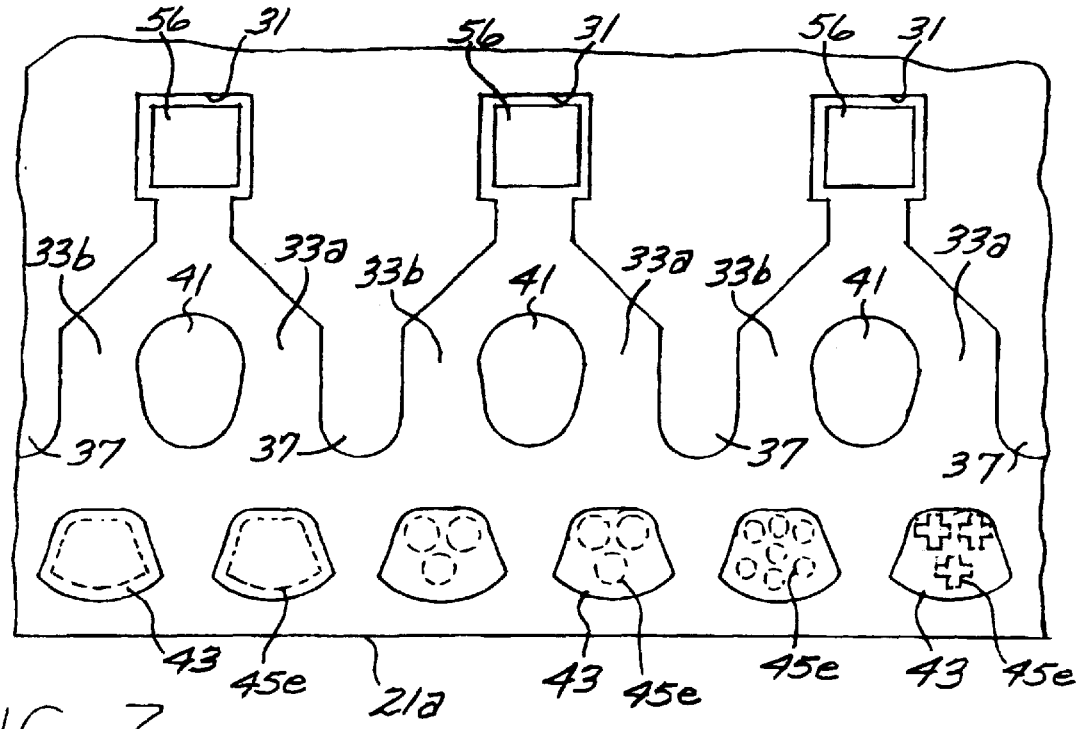
FIG. 7 is a schematic top plan view illustrating another example of a thin film metal underlay structure that underlies selected portions of the barrier layer of the printhead of FIGS. 2 and 3.

FIG. 7 is an unscaled partial top plan view illustrating embodiments wherein the thin film metal structure comprises a set of one or more metal buttons 45*e* formed in the aluminum layer 55 or the tantalum layer 61 and located beneath a corresponding barrier reef island 43. A set of one or more buttons can additionally be located beneath a selected channel island 41. The button(s) 45*e* can be of any selected shape. FIG. 7 depicts various configurations and arrangements of buttons for illustrative purposes, and it should be appreciated that in any given printhead, a uniform configuration and arrangement of buttons can be employed.

Figure 8:
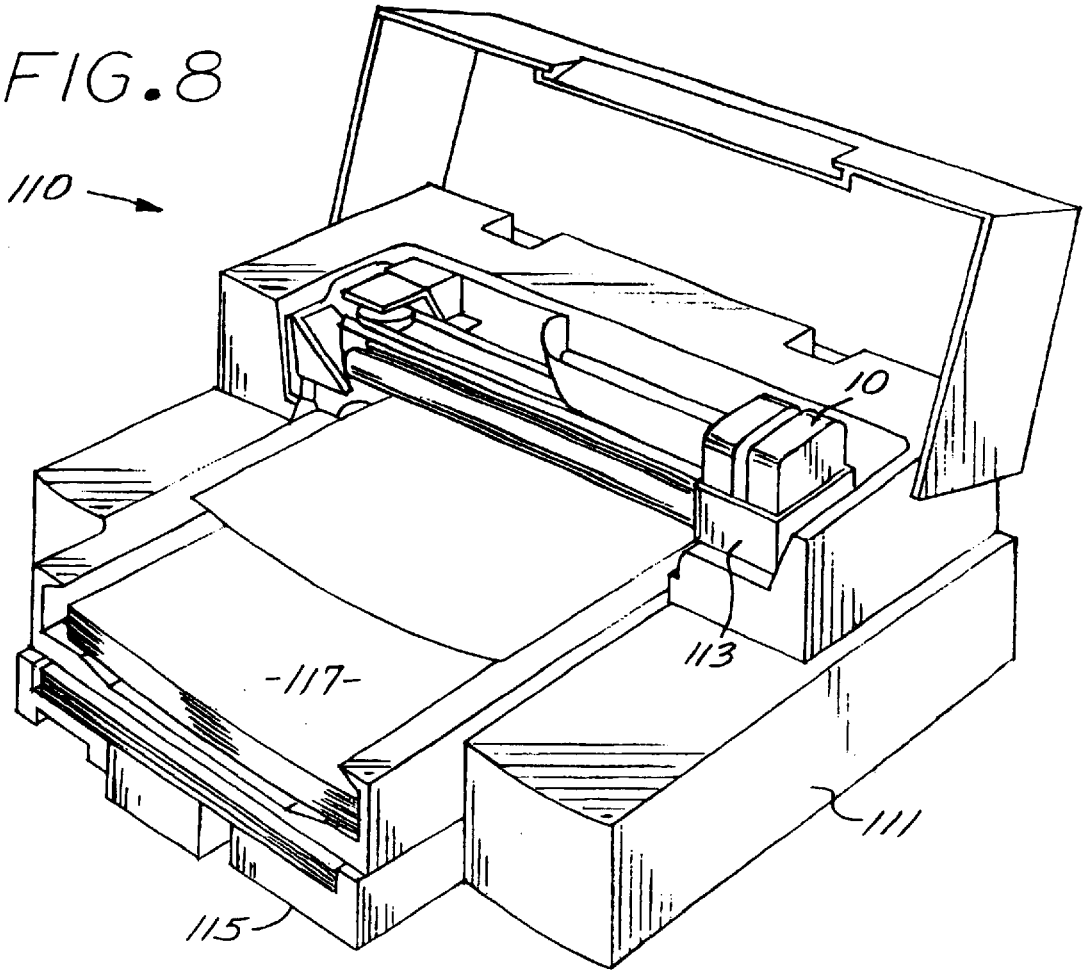
FIG. 8 depicts an example of a printing system that can employ the printhead of FIGS. 2 and 3.

FIG. 8 is a perspective view of an exemplary implementation of an ink jet printing system 110 in which the disclosed print cartridge 10 can be employed. The printing system 110 includes a printer portion 111 having at least one print cartridge 10 installed in a scanning carriage 113. The printer portion 111 includes a media tray 115 for receiving print media 117. As a sheet of print media is stepped through a print zone in the printer portion 111, the scanning carriage moves the print cartridge(s) 10 across the print media. The printer portion 111 selectively activates drop generators of the printhead of the print cartridge 10 to deposit ink on the print media to thereby accomplish printing.

The foregoing has thus been a disclosure of a fluid drop emitting device that is useful in inkjet printing as well as other drop emitting applications such as medical devices, and techniques for making such fluid drop emitting device.

Although the foregoing has been a description and illustration of specific embodiments of the invention, various modifications and changes thereto can be made by persons skilled in the art without departing from the scope and spirit of the invention as defined by the following claims.

What is claimed is:

1. A fluid drop ejecting apparatus comprising:

a substrate having a fluid feed edge;

a thin film stack including a plurality of heater resistors formed on said substrate;

a patterned fluid barrier layer disposed on said thin film stack;

respective fluid chambers formed in said fluid barrier layer over respective heater resistors;

respective nozzles disposed over said respective fluid chambers and said heater resistors;

fluid feed features formed in said fluid barrier layer adjacent said fluid feed edge;

a thin film metal structure formed in a metal layer of said thin film stack and located beneath said fluid feed features.

2. The fluid drop ejecting apparatus of claim 1 wherein said thin film metal structure comprises a metal region that underlies said fluid feed features adjacent said fluid feed edge.

3. The fluid drop ejecting apparatus of claim 2 wherein said metal region comprises a metal strip.

4. The fluid drop ejecting apparatus of claim 2 wherein said metal region comprises a metal slab that extends toward said fluid chambers.

5. The fluid drop ejecting apparatus of claim 2 wherein said metal region comprises a tantalum region.

6. The fluid drop ejecting apparatus of claim 5 wherein said tantalum region is in contact with said barrier layer.

7. The fluid drop ejecting apparatus of claim 2 wherein said metal region comprises an aluminum region.

8. The fluid drop ejecting apparatus of claim 1 wherein said thin film metal structures comprises a plurality of metal regions.

9. The fluid drop ejecting apparatus of claim 8 wherein said metal regions comprise tantalum regions.

10. The fluid drop ejecting apparatus of claim 9 wherein said tantalum regions are in contact with said barrier layer.

11. The fluid drop ejecting apparatus of claim 8 wherein said metal regions comprise aluminum regions.

12. The fluid drop ejecting apparatus of claim 8 wherein said metal regions occupy a region that underlies said fluid feed features and extends toward said fluid chambers.

13. A fluid drop ejecting apparatus comprising:

a substrate having a fluid feed edge;

a thin film stack including a plurality of heater resistors formed on said substrate;

a patterned fluid barrier layer disposed on said thin film stack;

respective fluid chambers formed in said fluid barrier layer over respective heater resistors;

respective nozzles disposed over said respective fluid chambers and said heater resistors;

barrier islands formed in said fluid barrier layer adjacent said fluid feed edge; and a thin film metal structure formed in a metal layer of said thin film stack and located beneath said barrier islands.

14. The fluid drop ejecting apparatus of claim 13 wherein said thin film metal structure comprises a metal region that underlies said barrier islands.

15. The fluid drop ejecting apparatus of claim 14 wherein said metal region comprises a metal strip.

16. The fluid drop ejecting apparatus of claim 14 wherein said metal region comprises a metal slab that extends toward said fluid chambers.

17. The fluid drop ejecting apparatus of claim 14 wherein said metal region comprises a tantalum region.

18. The fluid drop ejecting apparatus of claim 17 wherein said tantalum region is in contact with said barrier layer.

19. The fluid drop ejecting apparatus of claim 14 wherein said metal region comprises an aluminum region.

20. The fluid drop ejecting apparatus of claim 13 wherein said thin film metal structure comprises a plurality of metal regions.

21. The fluid drop ejecting apparatus of claim 20 wherein said metal regions comprise tantalum regions.

22. The fluid drop ejecting apparatus of claim 21 wherein said tantalum regions are in contact with said barrier layer.

23. The fluid drop ejecting apparatus of claim 20 wherein said metal regions comprise aluminum regions.

24. The fluid drop ejecting apparatus of claim 20 wherein said metal regions occupy a region that underlies said barrier islands and extends toward said fluid chambers.

25. An ink jet printhead comprising:

a substrate having a fluid feed edge;

a thin film stack formed on said substrate, said thin film stack including an aluminum layer, a tantalum layer, and heater resistors;

a patterned fluid barrier layer disposed on said tantalum layer;

respective fluid chambers formed in said fluid barrier layer over respective heater resistors;

respective nozzles disposed over said respective fluid chambers and said heater resistors;

barrier islands formed in said fluid barrier layer adjacent said fluid feed edge; and a thin film metal structure disposed beneath said barrier islands and formed in at least one of said aluminum layer and said tantalum layer.

26. The ink jet printhead of claim 25 wherein said thin film metal structure comprises a metal region that underlies said barrier islands.

27. The ink jet printhead of claim 26 wherein said metal region comprises a metal strip.

28. The ink jet printhead of claim 26 wherein said metal region comprises a metal slab that extends toward said fluid chambers.

29. The ink jet printhead of claim 26 wherein said metal region comprises a tantalum region that is in contact with said barrier islands.

30. The ink jet printhead of claim 25 wherein said thin film metal structure comprises a plurality of metal regions.

31. The ink jet printhead of claim 30 wherein said metal regions comprise tantalum regions that are in contact with said barrier islands.

32. The ink jet printhead of claim 30 wherein said metal regions occupy a region that underlies said barrier islands and extends toward said fluid chambers.

* * * * *